US007919740B2

(12) United States Patent
Feuerstein

(10) Patent No.: US 7,919,740 B2
(45) Date of Patent: Apr. 5, 2011

(54) WING-UNFOLDING APPARATUS, FOLDING WING ASSEMBLY, AND VEHICLE WITH FOLDING WING ASSEMBLIES

(75) Inventor: Michael Feuerstein, Ertingen (DE)

(73) Assignee: DIEHL BGT Defence GmbH & Co. KG, Ueberlingen (DE)

( * ) Notice: Subject to any disclaimer, the term of this patent is extended or adjusted under 35 U.S.C. 154(b) by 702 days.

(21) Appl. No.: 12/015,529

(22) Filed: Jan. 17, 2008

(65) Prior Publication Data

US 2009/0008496 A1 Jan. 8, 2009

(30) Foreign Application Priority Data

Jan. 19, 2007 (DE) ..... 10 2007 002 948

(51) Int. Cl.
*F42B 15/01* (2006.01)

(52) U.S. Cl. ..... 244/3.25; 244/3.24; 244/3.28

(58) Field of Classification Search ..... 244/3.25, 244/3.24, 3.28, 3.27, 3.29
See application file for complete search history.

(56) References Cited

U.S. PATENT DOCUMENTS

| | | | | |
|---|---|---|---|---|
| 3,978,790 | A * | 9/1976 | Sandelius | 102/388 |
| 5,014,931 | A * | 5/1991 | Mikhail | 244/3.25 |
| 5,685,503 | A | 11/1997 | Trouillot et al. | |
| 5,744,748 | A | 4/1998 | Mikhail | |
| 6,152,041 | A * | 11/2000 | Harris et al. | 102/384 |
| 6,314,886 | B1 | 11/2001 | Kuhnle et al. | |
| 6,454,205 | B2 * | 9/2002 | Niemeyer et al. | 244/3.26 |
| 6,581,871 | B2 * | 6/2003 | Pijaca et al. | 244/3.27 |
| 2007/0102568 | A1 * | 5/2007 | Higgins et al. | 244/3.25 |

FOREIGN PATENT DOCUMENTS

| | | | |
|---|---|---|---|
| DE | 8438269 | U1 | 5/1989 |
| DE | 4105142 | A1 | 8/1992 |
| DE | 19906969 | A1 | 8/2000 |
| DE | 102004039770 | A1 | 3/2006 |
| EP | 0186903 | A1 | 7/1986 |
| EP | 0690284 | A1 | 1/1996 |

* cited by examiner

*Primary Examiner* — Christopher P Ellis
(74) *Attorney, Agent, or Firm* — Laurence A. Greenberg; Werner H. Stemer; Ralph E. Locher

(57) ABSTRACT

An apparatus for wing unfolding is particularly suited for an airborne vehicle. The apparatus has a base body with a longitudinal axis, a number of moveable flaps, and a number of lateral recesses. Attachment devices are configured for fitting the base body to an end face of a wing, with the one or more moveable flap being formed to influence a drag of the wing. Each lateral recess is designed for self-detachable attachment of the base body to the wing. Furthermore, a folding wing is specified, in particular for an airborne vehicle, having a wing, having a swiveling mechanism for extension of the wing to a limit position, having a wing pocket for holding the wing on the longitudinal side in the retracted state, and having an apparatus, which is arranged at the end, for wing unfolding of the type already known. A flying object, such as a guided missile, has a number of such folding wing assemblies.

27 Claims, 5 Drawing Sheets

FIG. 7
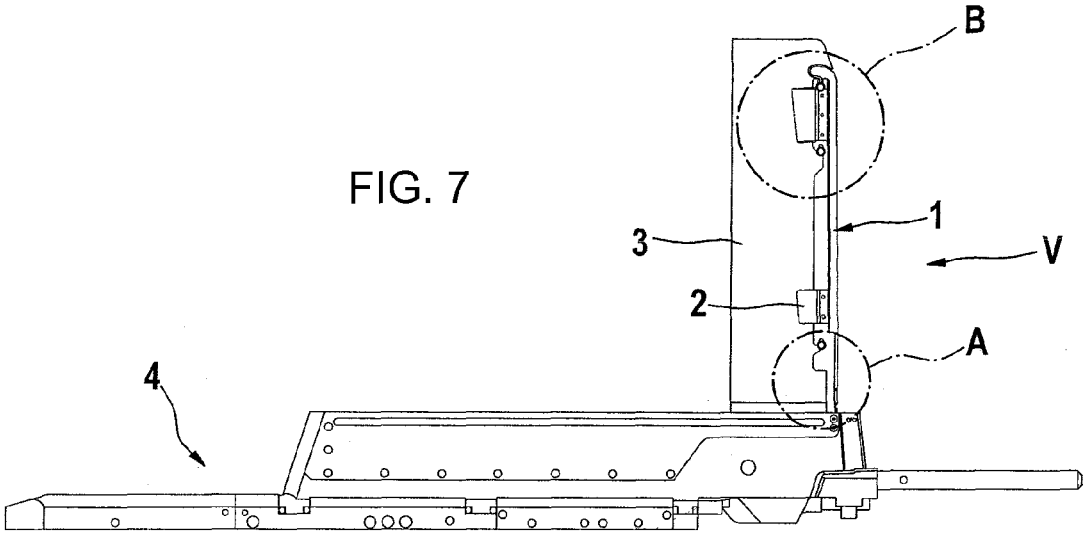
FIG. 7A
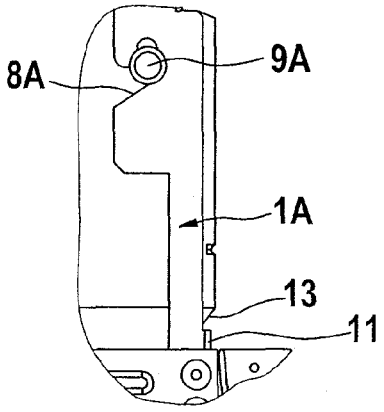
FIG. 7A
FIG. 7B
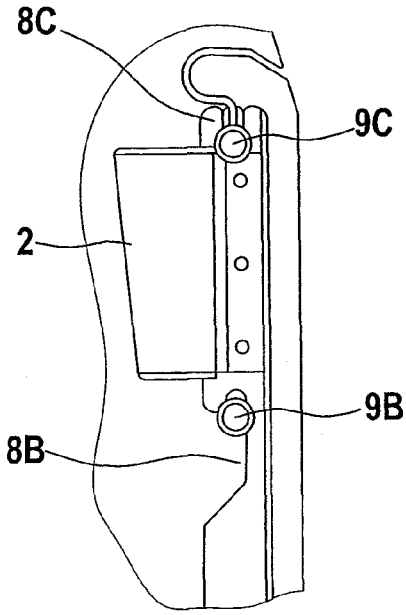
FIG. 7B

WING-UNFOLDING APPARATUS, FOLDING WING ASSEMBLY, AND VEHICLE WITH FOLDING WING ASSEMBLIES

CROSS-REFERENCE TO RELATED APPLICATION

This application claims the priority, under 35 U.S.C. §119, of German application DE 10 200 700 2948.0, filed Jan. 19, 2007; the prior application is herewith incorporated by reference in its entirety.

BACKGROUND OF THE INVENTION

Field of the Invention

The invention relates to an apparatus for wing unfolding, and to a folding wing having an apparatus such as this, in particular for an airborne vehicle.

An airborne vehicle, such as a guided missile for use in a defense system, generally has wings or stabilization surfaces which project from its elongated body and give it the aerodynamic characteristics required for the flight phase. Wings or stabilization surfaces such as these are in fact an impediment for storage, for transportation, and for launching an airborne vehicle such as this. For this reason, folding wings are used, which are folded in when the airborne vehicle is in the basic state, and are unfolded only in the flight phase. A folding wing such as this normally has a wing which can swivel and is provided with an apparatus which initiates the unfolding or extension of the wing at the start of the flight phase. A folding wing having an apparatus such as this for wing unfolding is subject to constraints relating to its size and mass, since the folding wing when in the folded state must in any case not significantly increase the size of the predetermined external contour of the airborne vehicle. In addition, the folding wing must not increase the mass of the airborne vehicle to an extent which is disadvantageous for the flight phase or for its range.

An apparatus for wing unfolding for a folding wing of a guided missile is known from the prior art, in which the wing which is associated with the folding wing is stored by being swiveled into a wing pocket which rests along the airborne vehicle. In the flight phase, the wing is swiveled out by the use of mechanical and/or pyrotechnic aids.

However, in general it is impossible to swivel the wing out to its limit position just by means of mechanical aids such as spring packs or actuators, because the integration volume which is governed by the external contours is too small. Right from the start, there is therefore a restriction to the possible effect of mechanical aids. Furthermore, possible arrangement positions are poor for the lever effect of the aids on the wing and, furthermore, even at the start of the flight phase of the airborne vehicle, inertia forces occur which can make it more difficult to swivel the wing out.

BRIEF SUMMARY OF THE INVENTION

It is accordingly a first object of the invention to provide a wing-unfolding device, which overcomes the above-mentioned disadvantages of the heretofore-known known devices and methods of this general type and which provides for an apparatus by means of which the unfolding process for a folding wing is carried out as reliably as possible, subject to the restriction of the small integration volume, and if possible without any adverse effect on the flow behavior after the unfolding process.

A further object of the invention is to specify a folding wing which is unfolded as reliably as possible during the flight phase and which requires as small an integration volume as possible.

A third object of the invention is to describe an airborne vehicle which has the aerodynamic characteristics required in operational conditions.

With the foregoing and other objects in view there is provided, in accordance with the invention, an apparatus for wing unfolding, comprising:

a base body extending along a longitudinal axis;

the base body having one or a plurality of lateral recesses formed therein;

attachment means configured to mount the base body to an end face of a wing; and one or a plurality of moveable flaps configured to influence a drag on the wing;

wherein the one or more lateral recesses are configured for self-detachable attachment of the base body from the wing in a limit position.

In other words, the first object is achieved in that an apparatus for wing unfolding, in particular for an airborne vehicle, has a base body which extends along a longitudinal axis, has an attachment means, has a number of moveable flaps, and has a number of lateral recesses, with the attachment means being designed for fitting the base body to an end face of a wing, with the or each moveable flap being designed to influence the drag of the wing or the control surface, and with the or each lateral recess being designed for self-detachable attachment of the base body to the wing or the control surface in a limit position.

A first concept of the invention is based on the idea of fitting flaps to the wings, which increase the wing drag and thus effectively assist in extending it to the limit position. This results in reliable unfolding.

In a second concept, the invention recognizes that the increase in the drag, which is intrinsically advantageous for the unfolding process, is disadvantageous for the aerodynamic characteristics of the flying object. The flight response of the airborne vehicle is considerably adversely affected. The airborne vehicle is braked, slowed down, and its range is reduced, or the fuel consumption is increased in order to compensate for the shorter range and reduced speed.

Finally, a third concept of the invention is based on the idea of initiating self-detachment of the attachment of the apparatus to the wing on reaching the limit position. This results in an increase in the drag, which is effectively used only for the unfolding process. After being unfolded, the performance parameters of the wing are no longer disadvantageously influenced by the apparatus, that is to say in particular by the flaps arranged on it, since it is then no longer present. Furthermore, the use of pyrotechnic elements is superfluous. The apparatus which is detached from the wing on reaching the intended limit position is lifted off the wing in a controlled manner by its increased drag, and is removed from the airborne vehicle in a desired manner. There is no need to be concerned about any collision with the airborne vehicle.

The apparatus for wing unfolding is advantageously characterized in that the attachment means has a longitudinal recess which has a negative shape corresponding to the end face of the wing. A longitudinal recess such as this allows the base body to be fitted to the end of the wing with an accurate fit.

Furthermore, at one end, the base body advantageously has an unlatching means, in particular an incline, which produces an impulse on the base body along its longitudinal axis when struck, in particular in the direction of the opposite end of the base body. This stop can in particular be linked to the predetermined limit position being reached. When the wing is extended to the limit position during the unfolding process, then, on reaching the limit position, the unlatching means runs into the stop, thus detaching the unlatching means. If the unlatching is provided by an impulse along the longitudinal direction, then the apparatus for wing unfolding is moved away from the airborne vehicle. The detachment by means of a longitudinal movement of the base body is additionally assisted by the mass inertia of the base body.

In one advantageous development of the last-mentioned embodiment variant of the apparatus, the unlatching means is provided by the or each lateral recess being designed such that any movement of the apparatus from a limit position along the longitudinal axis initiates release of the attachment.

For this purpose, the or each recess is preferably in the form of a hook, so that the apparatus can be fixed, in particular by locking bolts, in the limit position. The locking bolts are in this way suitably associated with the wing. The hook shape of the or each recess allows a longitudinal movement of the base body such that, in a holding position, the base body is fixed to the wing, and the fixing is detached in a position through a shift through a minimum length in the longitudinal direction with respect to the holding position.

In order to influence the detachment process of the attachment of the apparatus in particular as a function of the shape of the base body, of the unlatching means and of the mass inertia forces that act during the unfolding process, a plurality of recesses are provided and have a respectively different length and shape as a function of the position with respect to the longitudinal axis. For example, the use of two lateral recesses of different length, which are positioned at a distance from one another along the longitudinal axis, makes it possible for the wing to be detached from the lateral recesses at different times, so that the base body forms a specific angle with respect to the wing, at the moment when it is detached from the wing.

In a further advantageous embodiment of the apparatus, flaps which can be moved in pairs are arranged opposite one another along the longitudinal axis. If the apparatus is fitted to a wing, then these moveable flaps are used to symmetrically increase the drag on the wing, on both of its sides. Deliberately increasing the drag of the wing results in the wing being extended reliably in the unfolding process.

The flaps are advantageously provided with a spring mechanism which is designed, an initiation, to extend the flaps. Since the flaps are extended by their drag, a relatively simple spring mechanism is sufficient, for example using a mechanical compression or tension spring, in order to achieve complete extension of the flaps, in order to increase the drag, and thus to unfold the folding wing or the wing.

Since the apparatus is designed for a single use, it is advantageous to choose a suitable material which has the characteristics required for that purpose but which can nevertheless be produced at low cost. Plastics are particularly suitable for this purpose.

With the above and other objects in view there is also provided, in accordance with the invention, a folding wing assembly, comprising:

a wing;

a swiveling mechanism for extending the wing to a limit position;

a wing pocket configured for holding the wing on a longitudinal side in a retracted state; and a wing-unfolding apparatus, as outlined above, disposed at an end of the wing for unfolding the wing.

In other words, the second object is achieved in that a folding wing is specified, in particular for an airborne vehicle, having a wing, having a swiveling mechanism for extension of the wing to a limit position, having a wing pocket for holding the wing on the longitudinal side in the retracted state, and having an apparatus, which is arranged at the end of the wing, for wing unfolding of the type mentioned above.

A folding wing such as this is designed in a suitable manner to ensure that, when in the retracted state, the wing is not completely enclosed by the pocket, and the apparatus for wing unfolding is fitted to the end which projects out of the pocket.

Furthermore, a number of locking bolts are preferably provided in order to fix the apparatus to the wing. Each of these locking bolts engages in the respectively corresponding lateral recess of the apparatus with a force fit or in an interlocking manner for wing unfolding. Furthermore, the or each locking bolt can be mounted in a sprung manner. In consequence, and furthermore advantageously, the interaction of the or each locking bolt with the or each corresponding lateral recess in the apparatus can result in positive conditions to ensure that the movement of the apparatus is guided in a desired manner during the detachment process. In one application, by way of example, during the detachment process, the apparatus is detached first from those locking bolts which are located closer to the extension rotation point of the wing than locking bolts which are further away. In consequence, during the detachment process, the apparatus rotates about the locking bolts which are located further away before being entirely detached. This procedure is assisted by extended flaps which increase the drag. Partial rotation of the base body is therefore coupled to its translational detachment movement such that the base body includes a specific angle with the wing while being detached from the wing. Controlled detachment, which is achieved by presetting the coupling of the degrees of freedom of the detachment movement, is advantageous in order to prevent irregular movements of the base body during detachment, and thus possible collision with the flying object.

Further advantageous embodiment variants of the folding wing relate to its interaction and arrangement with respect to the or each moveable flap of the apparatus for wing unfolding. In one advantageous refinement, when the wing is in the retracted state, a flap such as this engages in the wing pocket where it is fixed, in particular in a prestressed manner, so that the flap itself is moved in. In the extended state, the flap lies essentially on the same plane as the longitudinal axis of the apparatus, and is at right angles to the wing. This refinement results in little integration volume being required in the retracted state. In the extended state, the drag which can be caused by the flap is as great as possible.

In order to allow the drag to act on a flap, it must be extended, and the projection of the area of the flap on a plane at right angles to the incident flow direction of the wing must be sufficiently large. The folding wing advantageously has a suitable release mechanism, by means of which the wing is moved quickly out of the wing pocket sufficiently that the or each moveable flap no longer interacts with the wing pocket and is no longer held prestressed by it. A release mechanism such as this can be provided by means of an actuator or spring mechanism. In particular, this need not be designed to extend the wing as far as the limit position, and can therefore be designed to save space and such that it can be integrated in the area of the wing pocket.

In one alternative or additional refinement, the folding wing is advantageously equipped with a sensor/actuator system which, when the wing is in the extended state, in the area of the limit position, initiates a detachment impulse which is transmitted to the base body of the apparatus for wing unfolding. If the base body has an impact-reactive unlatching means, a sensor/actuator system can additionally be made use of. The apparatus is released from its anchorage by the detachment impulse together with the mass inertia of the base body. Furthermore, when the wing is in the extended state, its longitudinal axis is advantageously essentially at right angles to the longitudinal axis of the wing pocket. For a folding wing designed in this way, the detachment process for the apparatus for wing unfolding can be designed in a simple manner.

The third object of the invention is achieved by an airborne vehicle which is equipped with a number of folding wings of the type described above.

An apparatus for wing unfolding and a folding wing of the type described above are in principle also suitable for use on underwater projectiles or submarine vehicles, with the specific embodiment of the apparatus and of the folding wing, which acts as a control surface, having to be matched to the specific hydrodynamic requirements.

Other features which are considered as characteristic for the invention are set forth in the appended claims.

Although the invention is illustrated and described herein as embodied in apparatus for wing unfolding, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 7 is a side view of the folding wing with the apparatus as shown in FIG. 1, after initiation of the detachment impulse;

FIGS. 7A and 7B illustrate details of the detachment process;

DETAILED DESCRIPTION OF THE INVENTION

Figure 1:
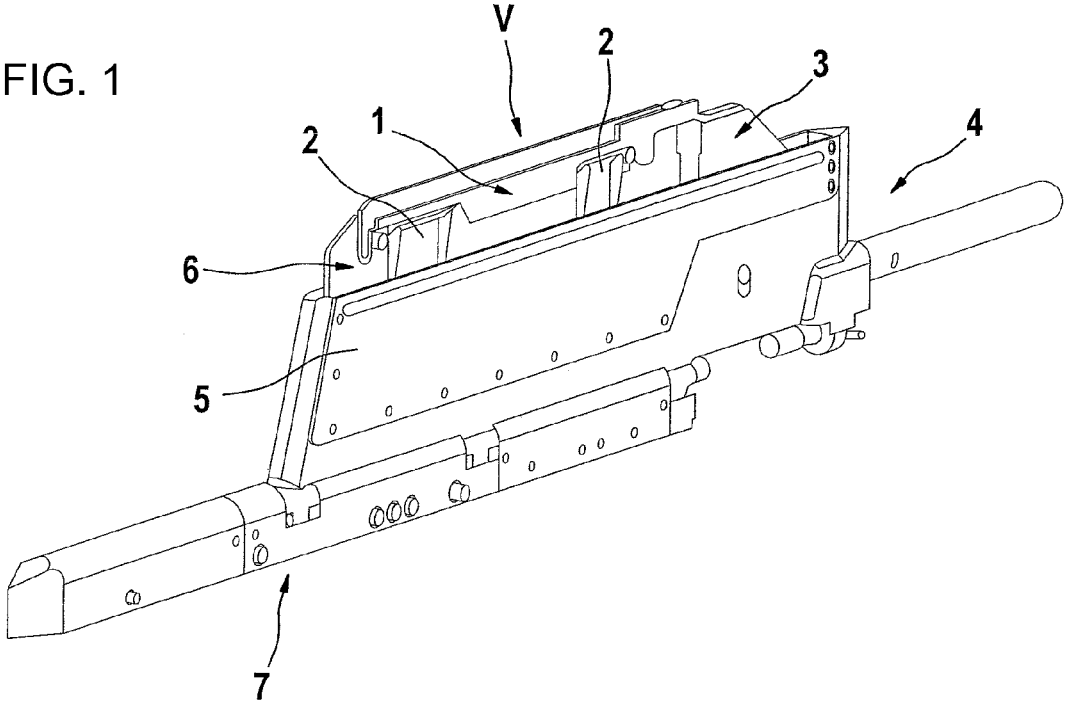
FIG. 1 is a perspective view of a folding wing with an apparatus for wing unfolding according to the invention, in the retracted state.

Referring now to the figures of the drawing in detail and first, particularly, to FIG. 1 thereof, there is shown an apparatus V for wing unfolding having a base body 1 and having moveable flaps 2 which are fitted to a pivotable wing 3 of a folding wing 4. In addition to the wing 3 which can swivel, the folding wing 4 has a wing pocket 5 which encloses the wing 3 that can swivel, in the retracted state as shown here. In this case, the area of the end 6 on which the apparatus 1 rests projects out of the wing pocket 5, and the movable flaps 2 of the apparatus are still engaged in the wing pocket 5 at the end. The movable flaps 2 are provided with a spring mechanism for extension, so that, in the illustration shown here, they are held in a prestressed manner by the wing pocket 5. Furthermore, the folding wing 4 has an attachment strip 7, on which the folding wing 4 is mounted on the airborne vehicle. The folding wing 4 is therefore fitted in the longitudinal direction to an airborne vehicle, which is not illustrated in any more detail, such that the folding wing 4 unfolds outwards in the radial direction with respect to the airborne vehicle.

Figure 2:
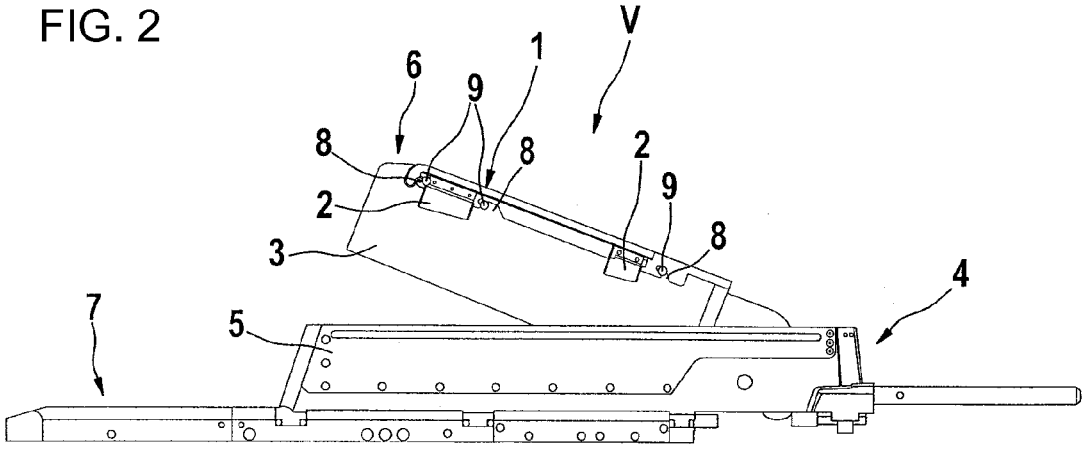
FIG. 2 is a side view of the folding wing with the apparatus as shown in FIG. 1, with the wing initially swiveled out.

FIG. 2 shows the folding wing 4 with the apparatus V as shown in FIG. 1, with the wing 3 initially swiveled out, in the form of a side view. The spring mechanism which is integrated in the wing pocket 5 forces the wing 3 out of the retracted state as illustrated in FIG. 1, during the flight phase. The lever effect of the spring mechanism is, however, not sufficient to swivel the wing 3 out completely. The moveable flaps 2, which are mounted on both sides of the wing 3 on the base body 1 of the apparatus V no longer interact with the wing pocket, and are extended by the associated spring mechanism. The illustration shows the flaps 2 at the moment at which they are extended, including an angle of about 45° at that time with the wing. Furthermore, the lateral recesses 8 on the base body 1 can be seen, as well as locking bolts 9 by means of which the apparatus V is fixed on the end 6 of the wing 3. The lateral recesses 8 have a predetermined length, as a function of their position relative to the wing.

Figure 3:
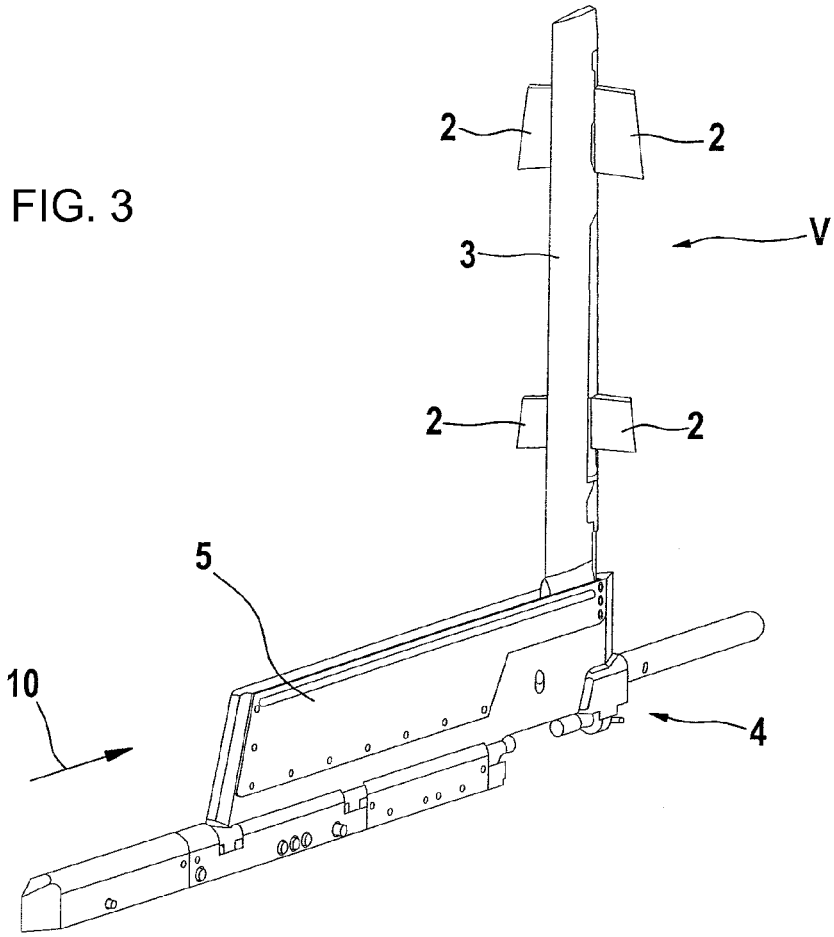
FIG. 3 is a perspective view, similar to FIG. 1, showing the folding wing with the apparatus of FIG. 1, with the wing swiveled out shortly before the limit position.

FIG. 3 shows the folding wing 4 with the apparatus V for wing unfolding as shown in FIG. 1, with the wing 3 swiveled out, shortly before reaching the limit position, in the form of a perspective view as shown in FIG. 1. The figure shows the extended flaps 2, which can be swiveled, on both sides of the wing 3, which is virtually at right angles to the wing pocket 5. The longitudinal direction 10 of the wing pocket 5 corresponds to the incident flow direction of the wing 3, so that, when in the extended state, the moveable flaps 2 produce the maximum drag. This drag results in the wing 3 being erected to the state shown here, from the swivel state illustrated in FIG. 2. As can be seen, drag such as this adversely affects the flying behaviour of the airborne vehicle after the opening process.

Figure 4:
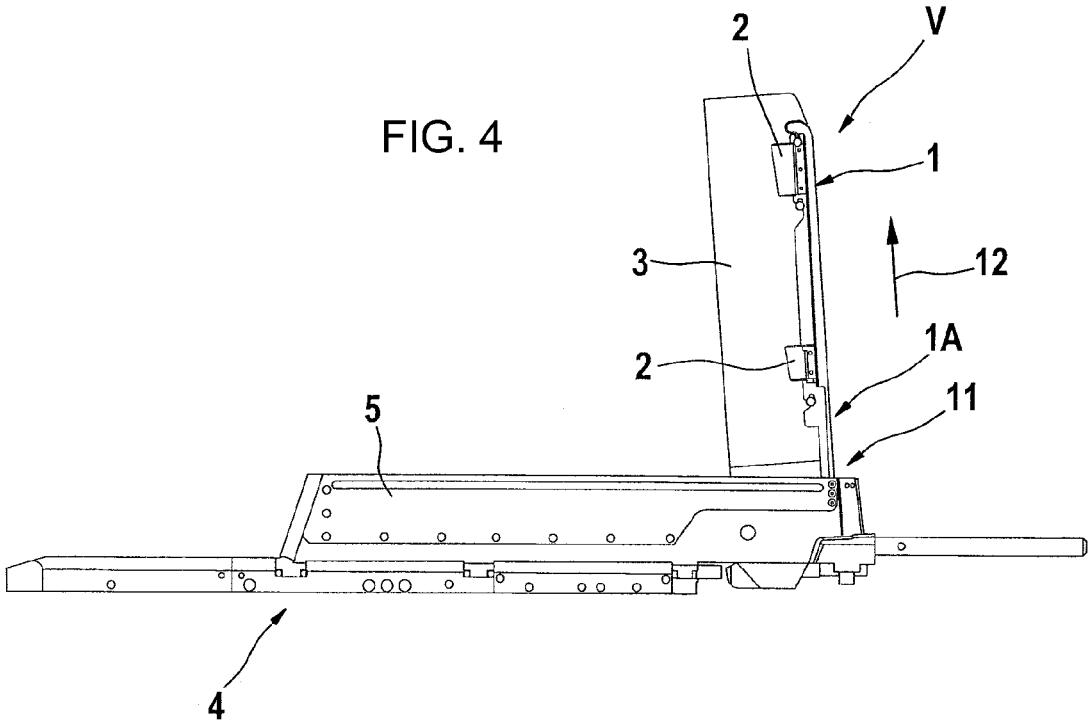
FIG. 4 is a side view of the folding wing with the apparatus as shown in FIG. 1, in a position identical to that shown in FIG. 3.

FIG. 4 now shows the folding wing 4 with the apparatus V as shown in FIG. 1, in a configuration identical to that shown in FIG. 3, in the form of a side view. Further details can be seen in FIG. 2. Shortly before the wing 3 reaches the limit position, the lower end face 1A of the base body 1 of the apparatus V runs into a stop 11. An inclined surface on the lower end of the base body 1 of the apparatus V results in this being given an impulse along the direction 12, that is to say in the longitudinal direction of the base body 1, and this is further enhanced by the mass inertia of the apparatus V.

Figure 5:
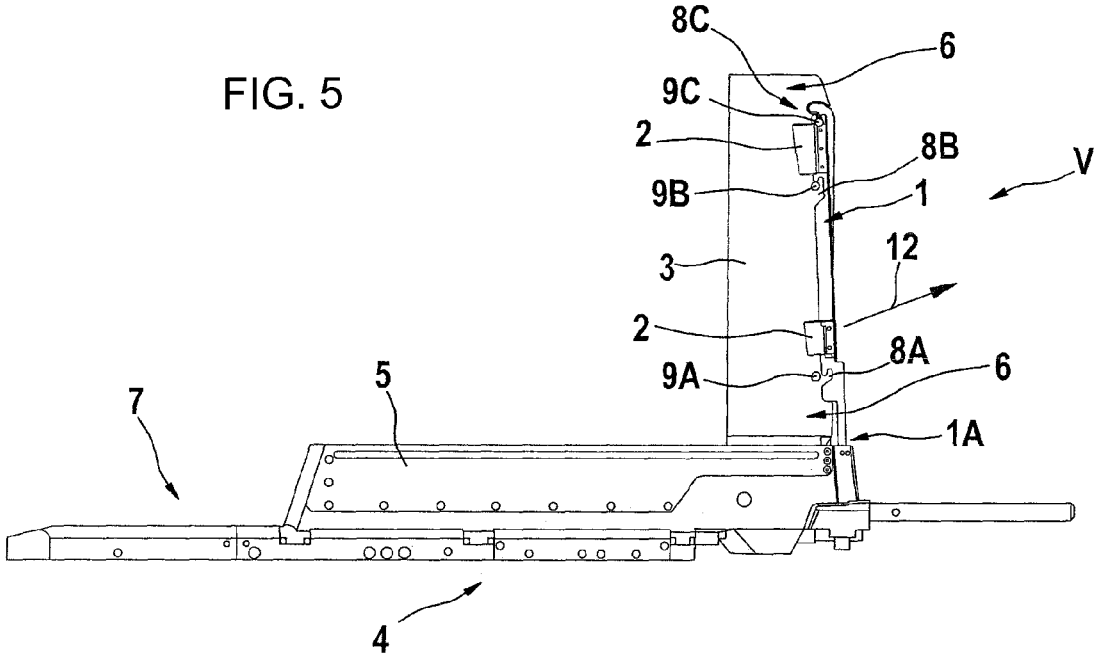
FIG. 5 is a side view of the folding wing with the apparatus as shown in FIG. 1 at the start of the detachment process, with the wing swiveled out completely in the limit position.
Figure 6:
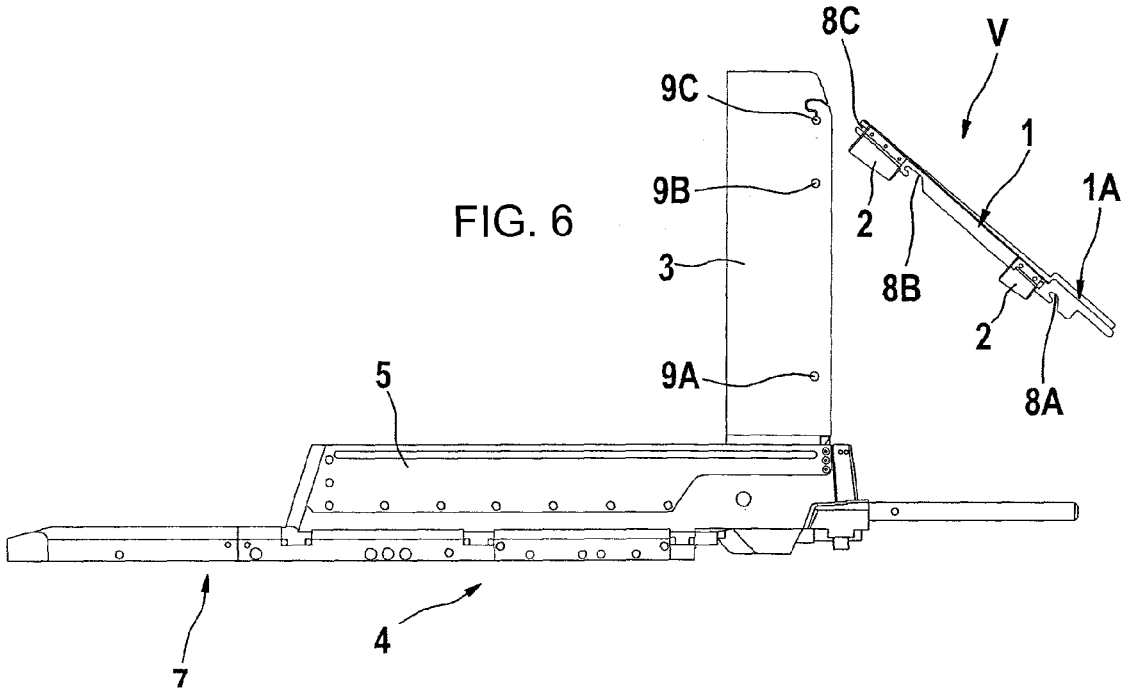
FIG. 6 is a side view of the folding wing with the apparatus as shown in FIG. 1 detached, with the wing swiveled out completely in the limit position.

FIG. 5 shows the folding wing with the apparatus as shown in FIG. 1 at the start of the detachment process, with the wing swiveled out completely in the limit position, in the form of a side view. Further details of the illustration can be seen in FIG. 2 and FIG. 4. The situation illustrated here immediately follows the situation illustration in FIG. 4. The impulse initiated in response to the impact causes the apparatus V to be unlatched on the lower lateral recesses 8A from the corresponding lower locking bolts 9A which are arranged on both surfaces of the wing 3. During this process, the configuration of the recesses 8A in the form of hooks results in the movement of the apparatus V first of all being diverted in the downstream direction 12, and in the lower end 1A of the base body 1 of the apparatus V becoming detached from the end 6 of the wing. The drag which still acts on the extended flaps 2 is now no longer transmitted to the wing 3 in the area of the lower end 1A of the base body 1. The drag now produces a lever effect which rotates the apparatus V at the lower end 1A of the base body 1 downstream away from the wing 3. This rotation results in the lateral recesses 8B being unlatched from the locking bolts 9B on both surfaces of the wing 3. This is immediately followed by the situation illustrated in FIG. 6.

The unlatching of the recesses 8B from the locking bolts 9B results in the base body 1 being rotated further, and in the process being rotated on the upper recesses 8C about the upper, spring-mounted locking bolts 9C. Beyond a predetermined rotation angle, which is governed by the shape of the recesses 8C, the apparatus V becomes completely unlatched from the wing 3, and is carried away by the flow. The detachment process, during which the longitudinal axis of the base body 1 forms a specific angle with the longitudinal axis of the wing 3, prevents the apparatus V from colliding, after detachment, with the flying object on which the folding wing 4 is mounted.

FIG. 7 shows the folding wing 4 with the apparatus for wing unfolding as shown in FIG. 1 after initiation of the detachment impulse, with detailed illustrations of the detachment process. The entire illustration corresponds to the situation which immediately follows the situation illustrated in FIG. 4, at the moment at which the detachment impulse has been initiated. The wing 3 is already in its limit position. The figure elements in FIG. 7A and FIG. 7B show details of the recesses 8A and 8B, 8C, respectively, with the corresponding locking bolts 9A, 9B, 9C. The detail of FIG. 7A shows an incline 13 at the lower end 1A of the base body 1 of the apparatus V as unlatching means, which incline 13 converts the impact impulse of the base body 1 against the stop 11 to a detachment impulse along the longitudinal direction of the base body. The longitudinal movement of the base body with respect to the wing 3 that has already taken place results in the end of the recess 8A being moved at this stage with respect to the corresponding locking bolt 9A. Detail FIG. 7B shows the corresponding movement of the recess 8B relative to the locking bolt 9B. The base body 1 is also connected to the wing 3 via the locking bolt 9C.

Figure 8:
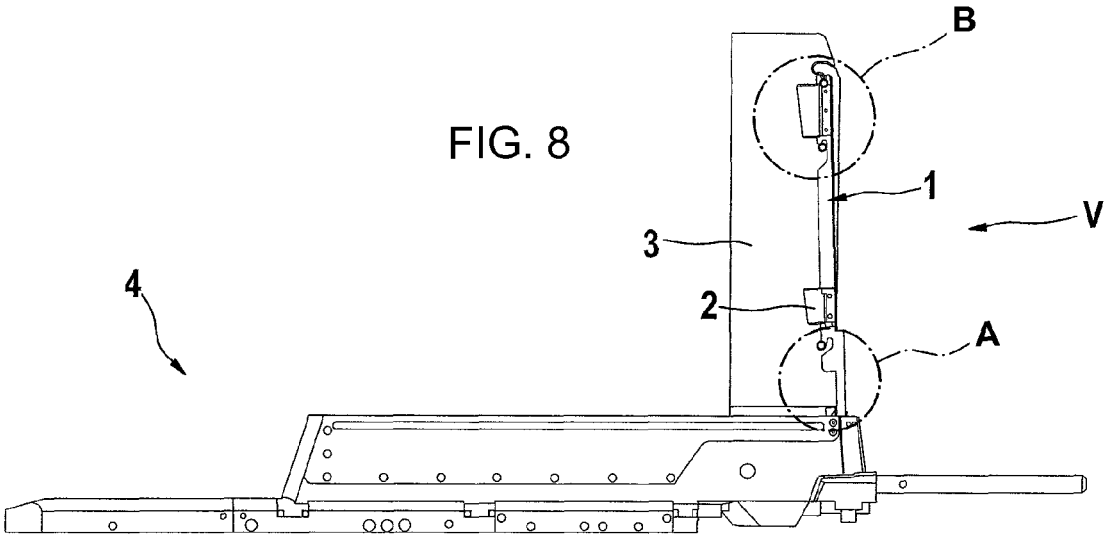
FIG. 8 is a side view of the folding wing with the apparatus as shown in FIG. 5 at the start of the detachment process.
Figure 8A:
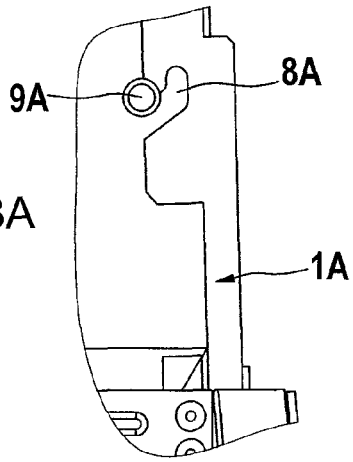
FIGS. 8A and 8B illustrated details of the detachment process.
Figure 8B:
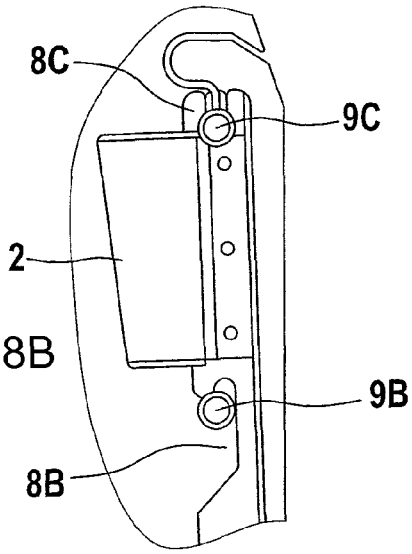

FIG. 8 shows the folding wing 4 with the apparatus as shown in FIG. 5 at the start of the detachment process, with detailed illustrations of the detachment process. The overall illustration corresponds to the situation shown in FIG. 5. The detail figures FIG. 8A and FIG. 8B show the same details as FIG. 7A and FIG. 7B, respectively, but at the time which corresponds to FIG. 5. FIG. 8A shows the detachment of the base body 1 from the wing 3 at the unlatching of the locking bolt 9A from the recess 8A. The unlatching movement of the locking bolt 9B from the recess 8B starts at the same time, and is shown in FIG. 8B. In this case, the apparatus V is rotated about the locking bolt 9C by the lever effect of the drag on the extended flaps 2 which can be moved on the recess 8C. The base body 1 of the apparatus V is detached from the wing 3.

The invention claimed is:

1. An apparatus for wing unfolding, comprising:

a base body extending along a longitudinal axis;

said base body having one or a plurality of lateral recesses formed therein;

attachment means configured to mount said base body to an end face of a wing; and one or a plurality of moveable flaps configured to influence a drag on the wing;

wherein said one or more lateral recesses are configured for self-detachable attachment of said base body from the wing in a limit position.

2. The apparatus according to claim 1, wherein said attachment means is formed with a longitudinal recess having a negative shape corresponding to the end face of the wing.

3. The apparatus according to claim 1, wherein said base body includes unlatching means at one end thereof.

4. The apparatus according to claim 3, wherein said unlatching means is an incline disposed to produces an impulse on said base body along said longitudinal axis when struck.

5. The apparatus according to claim 3, wherein said lateral recess is configured such that any movement of the apparatus in the limit position along the longitudinal axis initiates release of the attachment.

6. The apparatus according to claim 5, wherein said recess is hook-shaped and configured to fix the apparatus in the limit position.

7. The apparatus according to claim 6, which comprises locking bolts for fixing the apparatus in the limit position.

8. The apparatus according to claim 1, wherein said recess is one of a plurality of recesses along the longitudinal axis, each of said recesses having a different shape.

9. The apparatus according to claim 8, wherein said recesses have different shapes to influence the detachment process in dependence on a position along the longitudinal axis.

10. The apparatus according to claim 1, wherein said flaps are disposed in pairs with mutually opposite flaps disposed along the longitudinal axis.

11. The apparatus according to claim 1, which comprises a spring mechanism configured to extend said flaps on initiation.

12. The apparatus according to claim 1, wherein said apparatus is composed of plastic.

13. The apparatus according to claim 1, configured for an airborne vehicle with one or more wings.

14. A folding wing assembly, comprising:

a wing;

a swiveling mechanism for extending said wing to a limit position;

a wing pocket configured for holding said wing on a longitudinal side in a retracted state; and an apparatus according to claim 1 disposed at an end of said wing for unfolding said wing.

15. The folding wing assembly according to claim 14, configured for an airborne vehicle.

16. The folding wing assembly according to claim 14, wherein said wing has an end portion projecting out of said wing pocket in a retracted state, and said apparatus for wing unfolding is fitted to the projecting said end portion.

17. The folding wing assembly according to claim 14, which comprises one or a plurality of locking bolts fixing said apparatus for wing unfolding, and wherein each said locking bolt engages with a force fit or in a form lock in a respective said lateral recess in the apparatus.

18. The folding wing assembly according to claim 17, wherein each said locking bolt is mounted in a sprung manner.

19. The folding wing assembly according to claim 17, wherein each said locking bolt and a respectively corresponding lateral recess in the apparatus are configured for at least partial positive guidance of the apparatus during a detachment process.

20. The folding wing assembly according to claim 14, wherein each said flap of the apparatus, when said wing is in the retracted state, engages at an end in said wing pocket.

21. The folding wing assembly according to claim 20, wherein each said flap is fixed and prestressed at the end of said wing pocket.

22. The folding wing assembly according to claim 20, wherein each said flap of the apparatus, when in the extended state, is disposed substantially on a common plane with the longitudinal axis of the apparatus and at right angles to said wing.

23. The folding wing assembly according to claim 20, which comprises an actuator or spring mechanism configured to pivot said wing out of the retracted state such that, after activation of said actuator or spring mechanism, said flap no longer interacts with said wing pocket.

24. The folding wing assembly according to claim 14, which further comprises a sensor/actuator system configured to generate a detachment pulse and transmit the pulse to said apparatus, when said wing is in an extended state and in a region of the limit position.

25. The folding wing assembly according to claim 14, wherein said wing is mounted to assume an extended state with a longitudinal axis of said wing substantially at right angles to the longitudinal axis of said wing pocket.

26. A flying object, comprising a plurality of folding wing assemblies according to claim 14 mounted thereon.

27. The flying object according to claim 26 configured as a guided missile.

* * * * *